US006883218B2

(12) United States Patent
Kibben et al.

(10) Patent No.: US 6,883,218 B2
(45) Date of Patent: Apr. 26, 2005

(54) METHOD FOR THE PRODUCTION OF A COLD FORMED PIECE PART MADE OUT OF A STEEL PLATE

(75) Inventors: Martin Kibben, Dinslaken (DE); Thomas Flehming, Ratingen (DE); Klaus Blümel, Dinslaken (DE)

(73) Assignee: Thyssen Krupp Stahl AG, Dusseldorf (DE)

( * ) Notice: Subject to any disclaimer, the term of this patent is extended or adjusted under 35 U.S.C. 154(b) by 127 days.

(21) Appl. No.: 09/946,882

(22) Filed: Sep. 4, 2001

(65) Prior Publication Data

US 2002/0035772 A1 Mar. 28, 2002

(30) Foreign Application Priority Data

Sep. 8, 2000 (DE) ..... 100 44 682

(51) Int. Cl.[7] ..... B23Q 17/00
(52) U.S. Cl. ..... 29/407.05; 29/421.1; 72/369
(58) Field of Search ..... 29/890.148, 890.149, 29/897.2, 407.05, 421.1; 72/56, 58, 61, 368, 369, 370.14, 370.15, 370.23, 370.24, 370.25

(56) References Cited

U.S. PATENT DOCUMENTS 3,209,432 A * 10/1965 Cape ..... 29/897.2
5,333,775 A * 8/1994 Bruggemann et al. ..... 72/61
5,491,883 A * 2/1996 Marlinga ..... 29/421.1
5,924,316 A * 7/1999 Streubel et al. ..... 72/51
6,196,530 B1 * 3/2001 Muhr et al. ..... 72/369
6,311,965 B1 * 11/2001 Muhr et al. ..... 267/273
6,588,084 B2 * 7/2003 Dudziak ..... 29/421.1
6,591,653 B2 * 7/2003 Kim ..... 72/177
2003/0159289 A1 * 8/2003 Van Giezen ..... 29/897.2

FOREIGN PATENT DOCUMENTS

DE 41 04 256 A1 8/1992
EP 0 620 056 A1 10/1994
EP 0 869 265 A1 10/1998
EP 0 906 799 A1 * 4/1999
WO WO 99/62669 12/1999

* cited by examiner

*Primary Examiner*—David P. Bryant
(74) *Attorney, Agent, or Firm*—Proskauer Rose LLP

(57) ABSTRACT

This invention relates to a procedure for manufacturing cold-formed components (R) out of sheet steel and use of a sheet bar comprising the following steps: Generation of a sheet bar (P) out of a base plate (G), which consists of a first steel material; replacement of at least one section of the base plate (G) with a sheet steel blank (1, 2) whose thickness (D1, D2) or at least one material property differs from the first sheet steel (G), wherein the thickness (D1, D2) and/or deviating material property and the geometry of the sheet steel blank (1, 2) and its position in the sheet bar (P) are determined by the material flow during the ensuing cold forming process; and cold forming of the sheet bar (P) to fabricate the component (R). The procedure according to the invention ensures an improved result of cold forming, or even enables the manufacture of specific component shapes in the first place.

7 Claims, 2 Drawing Sheets

METHOD FOR THE PRODUCTION OF A COLD FORMED PIECE PART MADE OUT OF A STEEL PLATE

BACKGROUND OF THE INVENTION

The invention relates to a procedure and a sheet bar for manufacturing a component out of sheet steel via cold-forming, and to the use of a sheet bar.

During the manufacture of components out of sheet steel, flat sheet bar blanks are usually first manufactured, and then given their final shape in one or more cold-forming steps. In this case, the thickness and properties of the used steel material are determined by the area of the component exposed to the highest loads in practical operation, in particular with respect to larger components fabricated from a single sheet bar.

It has been shown in practice that cold forming sheet steel results in difficulties, for example if the component to be fabricated exhibits a complex shape in view of the deformation processes, or the sheet steel satisfies the requirements placed on its mechanical loading capacity, but is hard to deform due to its material properties. In addition, the thickness required with respect to its loading can complicate the deformation of sheet steel.

For example, when manufacturing curvilinear pipes, it often can be impossible to avoid excessive material thinning in the area of the outer curve of the respective pipe bend, and hence cracks, and also folds on the inner curve of the bend owing to excessive material accumulation. The danger of fold formation during bending can be diminished by using special bending mandrels. In addition, the pipe can be actively pushed during the bending process to influence the reduction in wall thickness in the area of the outer curve to a limited extent However, both measures require a high equipment outlay.

Another example for components with a complex shape that is hard to control with respect to cold forming involves deep drawn cups having a cornered base area. To prevent folds from forming in the area of the corners in such deep drawn parts during deep drawing, braking beads are incorporated on specific points of the deep drawing tool to prevent excessive material flow. At other points where an elevated flow of material is required, the deep drawning tool is lubricated to diminish friction between the material and sheet steel at this location. The outlay associated with these measures is also considerable, and does not yield success for certain materials.

The problems during cold deformation caused by the material properties of the used steel material stem from the fact that materials with a greater thickness or especially high strength must be used to satisfy the requirements placed on the respective component. It is often difficult or even impossible to impart the desired shape to sheet steels made in this way via cold deformation.

According to a procedure known from EF 0 906 799 A1, sheet steel blanks are welded onto a base plate in certain areas on a sheet bar intended for the manufacture of deep drawn body components. The welded-on sheet steel blanks reinforce the sheet bar in such a way that the component manufactured out of the sheet bar reliably satisfies the mechanical requirements placed on this part. To ensure that the welded-on sheet steel blanks also have a sufficient deformability, material accumulations are formed on the surface of the sheet steel blanks.

The procedure known from EP 0 906 799 A1 does make it possible to manufacture components having a high mechanical loading capacity at a diminished weight. However, practice has shown that it is hard to deform sheet bars reinforced in this way, despite the special design of the reinforcement sheet steel. This holds true in particular if the base plate onto which the reinforcement sheet steel is welded exhibits poor forming properties.

Proceeding from the prior art described above, the object of the invention is to provide a procedure that ensures an improved result of cold forming, or even enables the manufacture of specific component shapes in the first place. In addition, sheet bars with an improved formability are to be provided. Finally, advantageous uses for such sheet bars are to be specified.

SUMMARY OF THE INVENTION

A procedure for manufacturing cold-formed components out of sheet steel that solves the above object encompasses the following steps according to the invention:

Generation of a sheet bar out of a first base plate, which consists of a first steel material;

Replacement of at least one section of the base plate with a sheet steel blank whose thickness or at least one material property differs from the first sheet steel, wherein the thickness and/or deviating material property and the geometry of the sheet steel blank and its position in the sheet bar are determined by the material flow during the subsequent cold forming process;

Cold forming of the sheet bar to fabricate the component.

With respect to a sheet bar made out of sheet steel for generating a component via cold forming, the above object is achieved by having the sheet bar encompass a base plate in which at least one section is replaced by a sheet steel blank made out of a steel material that differs form the base plate of the sheet bar in terms of its thickness and/or at least one material property, wherein the geometry, the material property, the thickness and/or the position of the sheet steel blank are influenced by the material flow that arises while cold forming the sheet bar.

As opposed to the prior art mentioned at the outset, the position, shape and/or material properties of the sheet steel blank incorporated into the sheet bar are not determined by the requirements placed on the component fabricated out of the sheet bar in practical operation in the invention. Rather, the material flow that arises during the process of cold deformation is taken into account. It was surprisingly found that placing the sheet steel blanks at specific points according to the invention where critical or inadequate material flows arise during the process of cold deformation makes it possible to manufacture components that cannot be fabricated in a conventional manner via cold deformation.

According to the invention, the sheet steel blanks are placed in the sheet bar in such a way as to create a specific deformation reserve in areas that experience particularly high material flows. In addition, areas that are jammed during cold deformation can be designed in such a way according to the invention that material accumulations arise without the danger of fold formation. Further, proceeding according to the invention makes it possible to place sheet steel blanks in the sheet bar in such a way as to specifically force deformations that cannot be achieved via direct exposure to the tool used for shaping purposes.

The invention can also be used to advantage in cases where a sheet bar comprised of sheet steel that is hard to deform but optimal with respect to its mechanical properties is to be used for manufacturing a component The specific placement of sheet steel blanks provided by the invention in areas that have a significant influence on deformation makes it possible to impart complex shapes even to sheet bars made of difficultly deformable sheet steel materials.

Arranging the sheet steel blanks in the base plate of the sheet bar according to the invention makes it possible to specifically counteract different forming defects. These include in particular the local overloading of the material, a failure of deformations to set in due to stresses at the beginning of the forming process regionally lying under the yielding point of the material, as well as the termination of deformation due to a sudden drop below the yielding point during the forming process. Therefore, the invention provides a procedure that enables the reliable manufacture of even complexly shaped components. In addition, the specific placement of the sheet steel blanks makes it possible to manufacture cold-deformed components even using materials that are difficult or even impossible to form.

The required material properties, the thickness, geometry and/or the position of the respective sheet steel blanks in the sheet bar can be determined easily by imparting the shape of the component to be manufactured to a master sheet bar consisting only of a base plate in a first step, and then determining the areas of the component fabricated from the master sheet bar where the deformation did not satisfy the requirements, and finally allocating the inadequately deformed areas to those areas of the master sheet bar where the sheet steel blanks are to be used by tracing back the forming process. Based on the results obtained from the master sheet bar, the procedure according to the invention can be used, or sheet bars according to the invention can be manufactured in larger numbers. Costly practical experiments can be circumvented by using a simulation based on calculations according to the finite-element method to deform the master sheet bar to the component, determine the areas of inadequate deformation and trace back the forming process.

One alternative way to determine the details required for designing the sheet steel blanks supported by practical experiments involves providing the surface of the master sheet bar with dots, subsequently deforming the master sheet bar into the component, determining the dots lying in inadequately deformed areas given the detection of insufficiently deformed areas on the master sheet bar, and comparing the position of these dots on the component with the position of the respective dots on the non-deformed master sheet bar to trace back the forming procedure and determine those areas on the master sheet bar in which the sheet steel blanks are to be incorporated. Of course, a computer can here be used to assist in allocating position of the dots on the component to the position of the dots on the non-deformed component.

If the object is to induce a specific deformation of the sheet bar at a specific point or suppress a material accumulation to avoid fold formation during the course of cold deformation, this can be achieved while proceeding according to the invention by having the sheet steel blank exhibit a smaller formability relative to its position in the sheet bar than the sheet steel material of the sheet bar enveloping it. A sheet steel blank fabricated in this way and positioned in the sheet bar prevents the flow of material, and thereby contributes to a specific deformation of the sheet bar.

In other cases, it is beneficial for the sheet steel blank to have a higher formability relative to its position in the sheet bar than the material of the sheet bar enveloping it. For example, thinning can be specifically prevented in this way at points subjected to a particularly high flow of material during the course of cold deformation. This effectively suppresses the danger of crack formation. In this connection, it is especially advantageous if the thickness of the sheet steel blank to be essentially the same as the sheet width of the sheet bar after cold forming. By configuring the invention in this way, the thickness and material property of the sheet steel blank respectively incorporated into the sheet bar are selected in such a way that the component formed out of the sheet bar has a uniform external appearance.

Depending on the type of component made out of a sheet bar according to the invention, it makes sense to arrange a sheet steel blank whose thickness exceeds that of the sheet steel of the sheet bar enveloping it in the area subjected essentially to tensile stress during cold forming. For example, when manufacturing bent pipes, arranging a sheet steel blank fabricated in this way on the later outer curve makes it possible to avoid crack formation and excessive wall thinning. A sheet steel blank whose yield point exceeds that of the sheet steel of the sheet bar enveloping it can be arranged in the area subjected essentially to tensile stress during cold forming for the same purpose.

If essentially compressive stresses are generated in certain areas of the sheet bar during cold forming, so that material becomes jammed there, it is beneficial to arrange a sheet steel blank in this area whose yielding point is lower than the yielding point of the sheet steel of the sheet bar enveloping it, It also helps to insert a sheet steel blank in the respective area whose thickness is smaller than the thickness of the sheet steel of the sheet bar enveloping it.

The two above indicated designs are advantageous in cases where the danger of fold formation in the jammed area is slight or controlled during cold deformation. If this is not the case, the formation of folds in the areas subject to compressive stresses can be suppressed by arranging a sheet steel blank in the respective areas whose thickness exceeds the thickness of the sheet steel of the sheet bar enveloping it. A sheet steel blank fabricated in this manner effectively prevents the compressed sheet steel material from being thrown up. Complex bending progressions can be reliably generated during the manufacture of pipes, in particular when combining such a sheet steel blank with a sheet steel blank inserted into the sheet bar in the area of the subsequent outer curve that also has a higher sheet steel thickness and/or yielding point.

BRIEF DESCRIPTION OF THE DRAWINGS

In the following, the invention will be described in greater detail based on a drawing that shows an embodiment. Shown on.

DETAILED DESCRIPTION OF THE INVENTION

Figure 1:
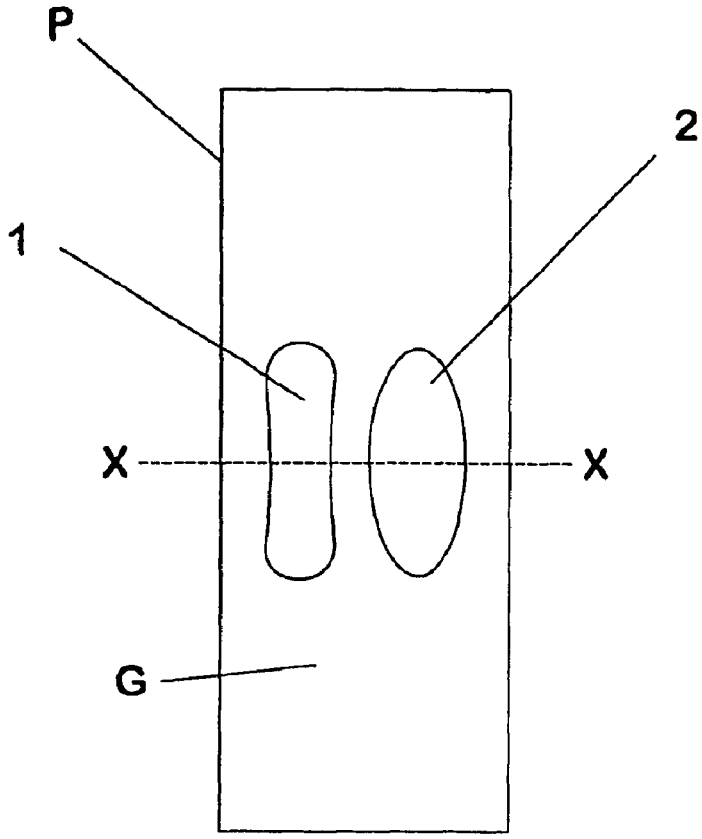
FIG. 1 is a sheet bar, top view.
Figure 1A:
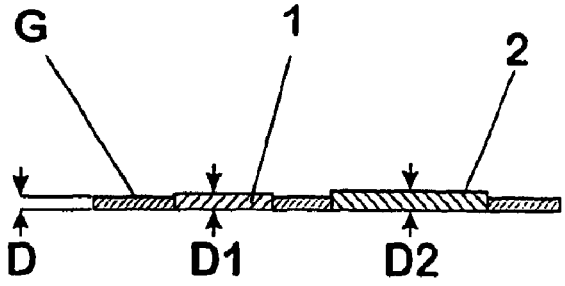
FIG. 1*a* is a section along the X—X line on FIG. 1.
Figure 2:
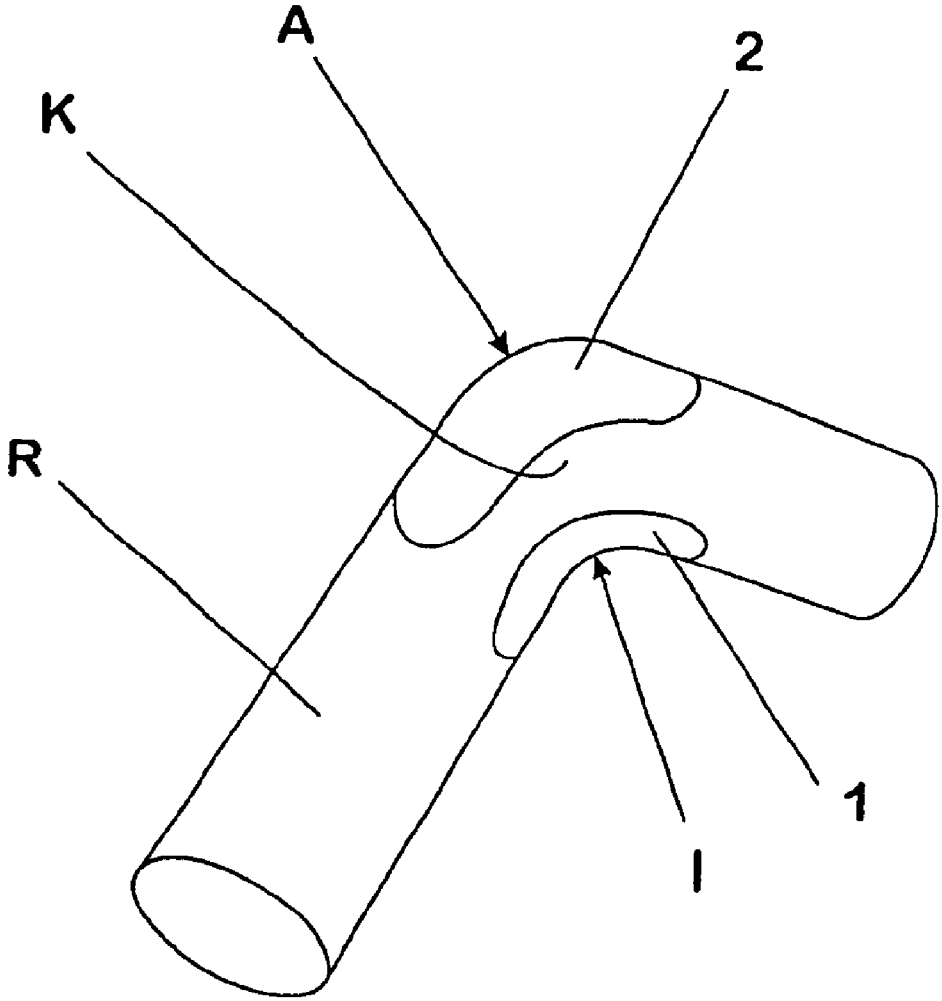
FIG. 2 is a perspective view of a pipe fabricated out of the sheet bar shown on FIG. 1.

The sheet bar P is essentially comprised of a base plate G, which consists of a first steel material. Its material properties and thickness D are adapted to the loads to which the pipe R to be manufactured out of the sheet bar P is exposed during practical operation. As shown on FIG. 2, the middle area of pipe R has a bend K.

A sheet steel blank 1 is incorporated into the sheet bar P in the area of sheet bar P from which the inner curve I of the bend K is formed in the pipe R. To this end, a section adjusted to the shape of the sheet steel blank 1 was cut into the base plate G in a manner known in the art. The sheet steel blank 1 was then inserted into this blank, and its edge area was welded to the base plate G, e.g., via laser welding. In like manner, a sheet steel blank 2 is incorporated into the sheet bar P in the area of the sheet bar P from which the outer curve A of the bend K is formed for the pipe R.

The sheet steel blank 1 is made out of a steel material that has a lower yielding point than the steel used to fabricate the base plate G of the sheet bar P. At the same time, the thickness D1 of the sheet steel blank 1 is greater than the thickness D of the base plate G. The sheet steel blank 2 has a thickness D2 that also exceeds the thickness of the base plate G.

During the manufacture of the pipe R, the base plate G is first cut out of the first steel material. Then, the sheet steel blanks 1 and 2 are placed into the base plate CG The sheet bar P formed in this way is then first pre-shaped into a linear pipe and bonded with longitudinal seams in a known manner.

In the last step, the bend K is introduced in the pipe R by cold deforming the pre-shaped straight pipe by bending in a suitable bending device. In this case, the sheet steel blank 2 represents a material reservoir and is exposed to tensile stress while bending the pipe, and its shape, position in the sheet bar P, material properties and thickness D2 prevent an excessive thinning of the material in the area of the outer curve A of the bend K that brings with it the risk of crack formation. In like manner, the position of the sheet steel blank 1 in the sheet bar P, its yielding point and its thickness D1 are selected in such a way that the sheet steel blank 1 in the inner curve I prevents the formation of folds that might arise without the use of the sheet steel blank 1 due to the compressive stresses that prevail in the area of the inner curve I during bending and trigger a jamming of the sheet steel material present there.

The position in the sheet bar P, the material properties, the thickness and the geometry of the sheet steel blanks 1, 2 were determined via simulations based on calculations according to the finite-element method, respectively. In this case, cold forming was initially simulated proceeding from a flat, only virtual master sheet bar consisting of the same material as the base plate G to a completely formed, virtual pipe whose shape corresponded to that of the pipe R to be generated. Areas of the pipe model fabricated in this way where excessive weakening of the component (outer curve) or fold formation (inner curve) took place were then marked. The size, type and progression of the deformation defects were also determined.

Subsequently, the deformation process was traced back keeping the same markings until the master sheet bar was again in its flat initial state. In this state, the position and shape of the areas into which the sheet steel blanks 1, 2 were to be placed were discernible from the markings. The necessary material properties and the thickness of the sheet steel blanks 1, 2 were then determined based on the deformation defects ascertained for the virtual pipe.

In an alternative procedure, the steps required for laying out the sheet steel blanks were determined using the measuring grid technique. To this end, a real, flat master sheet bar consisting of the same material as the base plate G was covered by dots in a non-deformed state. The spatial coordinates of these dots were determined and stored in a computer. The master sheet bar was then cold-formed into the shape of the pipe R. This deformation was accompanied by a shifting of the dots based on the material flow of the master sheet bar. The coordinates of the dots on the generated pipe lying in areas with insufficient deformation (outer curve, inner curve) were determined. Through inverse transformation, the position of the respective dots were calculated, and hence the position of the sheet steel blanks 1, 2 in the flat master sheet bar. The required material properties and the thickness of the sheet steel blanks 1, 2 were then again determined based on the deformation defects present on the pipe fabricated out of the master sheet bar.

LEGEND

1 Sheet steel blank ("Patch")
2 Sheet steel blank ("Patch")
A Outer curve
D Thickness of base plate G
D1 Thickness of sheet steel blank 1
D2 Thickness of sheet steel blank 2
G Base plate
I Inner curve
K Bend
P Sheet bar
R Pipe

What is claimed is:

1. Procedure for manufacturing a cold-formed component out of sheet steel, comprising the following steps:

producing a sheet bar out of a first base plate , which is made from a first steel material;

replacing at least one section of the base plate with a sheet steel blank having a thickness and/or at least one material property which differs from that of the first sheet steel, wherein the thickness and/or deviating material property and the geometry of the sheet steel blank and its position in the sheet bar are determined based on the material flow during the ensuing cold forming process; and cold forming the sheet bar to fabricate the component.

2. Procedure according to claim 1, wherein in order to determine the material properties, the thickness, the geometry and/or the position of the sheet steel blank, a master sheet bar comprising only a base plate is given the shape of the component to be fabricated;

areas on the component fabricated out of the master sheet bar where the deformation did not satisfy the requirements are determined; and inadequately deformed areas are allocated to those areas of the master sheet bar into which the sheet steel blanks are to be incorporated by tracing back the forming process.

3. Procedure according to claim 2, wherein a simulation performed according to a finite-element analysis is used to deform the master sheet bar into the component, determine the areas of insufficient deformation and trace back the forming process.

4. Procedure according to claim 2, wherein the surface of the master sheet bar is provided with dots, and the spatial coordinates of the dots are stored;

the master sheet bar is subsequently deformed into the component;

the dots lying in the insufficiently deformed areas are determined after the insufficiently deformed areas of the master sheet bar have been ascertained; and the positions of the dots lying in the insufficiently deformed areas on the component are compared with the original positions of the respective dots on the non-deformed master sheet bar to trace back the forming process and determine those areas of the master sheet bar into which the sheet steel blanks are to be incorporated.

5. Procedure according to claim 1, wherein the sheet steel blank has a lower forming capacity relative to its position in the sheet bar than the base plate of the sheet bar enveloping it.

6. Procedure according to claim 1, wherein the sheet steel blank has a higher forming capacity relative to its position in the sheet bar than the base plate of the sheet bar enveloping it.

7. Procedure according to claim 1, wherein the thickness of the steel blank (1, 2) is essentially the same as the sheet steel thickness of the base plate of the sheet bar after cold forming.

* * * * *